US006779606B1

(12) United States Patent
Lopez

(10) Patent No.: US 6,779,606 B1
(45) Date of Patent: Aug. 24, 2004

(54) METHOD AND APPARATUS FOR HEATING DRILLING AND/OR COMPLETION FLUIDS ENTERING OR LEAVING A WELL BORE DURING OIL AND GAS EXPLORATION AND PRODUCTION

(76) Inventor: Perry A. Lopez, 100 Gold Rush Dr., Lafayette, LA (US) 70506

( * ) Notice: Subject to any disclaimer, the term of this patent is extended or adjusted under 35 U.S.C. 154(b) by 0 days.

(21) Appl. No.: 10/267,461

(22) Filed: Oct. 9, 2002

(51) Int. Cl.[7] ..... E21B 21/01; E21B 21/06; E21B 36/00

(52) U.S. Cl. ..... 166/303; 166/57; 175/66; 175/206

(58) Field of Search ..... 175/66, 206, 207; 166/266, 267, 57, 302, 303; 165/157–167, 182

(56) References Cited

U.S. PATENT DOCUMENTS

| | | | | |
|---|---|---|---|---|
| 629,539 | A | | 7/1899 | Bertram |
| 749,718 | A | | 1/1904 | Chase |
| 1,881,176 | A | | 10/1932 | Epley |
| 2,341,574 | A | | 2/1944 | Reed |
| 3,055,647 | A | | 9/1962 | Morrison et al. |
| 3,115,195 | A | | 12/1963 | Graham |
| 3,172,487 | A | | 3/1965 | Klotz |
| 3,964,544 | A | | 6/1976 | Farley et al. |
| 4,372,386 | A | * | 2/1983 | Rhoades et al. ..... 166/300 |
| 4,683,963 | A | * | 8/1987 | Skinner ..... 175/66 |
| 4,730,673 | A | * | 3/1988 | Bradley ..... 166/272.3 |
| 4,913,245 | A | * | 4/1990 | Skinner ..... 175/66 |
| 5,641,022 | A | * | 6/1997 | King ..... 166/303 |
| 5,928,519 | A | * | 7/1999 | Homan ..... 210/741 |
| 5,979,549 | A | * | 11/1999 | Meeks ..... 166/57 |

OTHER PUBLICATIONS

Joe Schmidt, Manny Gonzalez, Ben Bloys, Greg Pepin "Mud Temperature Effects on Drilling Lost Returns For Deepwater Wells" Published on ip.com on May 17, 2002.

* cited by examiner

*Primary Examiner*—Hoang Dang
(74) *Attorney, Agent, or Firm*—Garvey, Smith, Nehrbass & Doody, L.L.C.; Gregory C. Smith

(57) ABSTRACT

A system for heating drilling, completion, and/or stimulation fluids including acidizing liquids but not limited to; entering or exiting a wellbore, the system including a principal heat exchange vessel; a first inlet for introducing heat transfer media into fluid flow lines within the vessel; an outlet for flowing the heat transfer media from the vessel; a second inlet for introducing fluids returning from or returning to the well bore for receiving heat from the heating fluid within the fluid flow lines in the vessel; an outlet for flowing the heated downhole fluids from the vessel to be returned down the borehole; a heater for heating the heating fluid to a desired temperature before returning the heating fluid to the heat exchange vessel. Optimally, the drilling or completion fluid would be heated to 50° to 60° F. above ambient temperature.

10 Claims, 3 Drawing Sheets

METHOD AND APPARATUS FOR HEATING DRILLING AND/OR COMPLETION FLUIDS ENTERING OR LEAVING A WELL BORE DURING OIL AND GAS EXPLORATION AND PRODUCTION

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to a system and method for heating drilling, completion, and/or stimulation fluids including acidizing liquids "fluids" but not limited thereto. More particularly, the present invention relates to a system and method for heating drilling and/or completion fluids entering or exiting a wellbore in order to enhance the stability of the well bore improve the capability of the fluids to retrieve solids from the borehole and enhance production.

2. General Background of the Invention

In the rotary drilling operation within the Exploration and Production industry there is a fluid that is universally called "drilling fluids/mud". The drilling fluid is circulated from a storage system "mud pits" on the surface of a drilling/production vessel downward through the drill pipe and out of the apertures "jets" of the drill bit and upward within the interior of the casing side of the wellbore and to the borehole to the surface. Returning to the surface, the drilling fluid carries "drilled cuttings" generated as the drill bit cuts the earthen formation and carries the drilled cuttings to the surface in the mud. At the surface the mud is treated through a variety of "solids control" equipment, i.e.: gumbo chain, shale shakers, de-sanders, de-silters, centrifuges, and cuttings dryers, etc. removing the drilled cuttings and ultimately returning the mud to the mud pits for reuse.

Today it is recognized that a drilling fluid has a number of important functions but not limited to the following:

1. Removes cuttings from the bottom of the hole and carries them to the surface
2. Holds cuttings and weight material in suspension when circulation is interrupted
3. Releases sand and cuttings at the surface
4. Walls the hole with an impermeable cake
5. Minimizes adverse effects upon the formation
6. Cools and lubricates the bit and drill string
7. Supports part of the weight of the drill stem and casing
8. Controls subsurface pressure
9. Transmits hydraulic horsepower
10. Maximizes downhole information obtained.

Removing cuttings from below the drill bit is still a crucial function of a drilling fluid. The circulatory fluid rising from the bottom of the well bore carries the cuttings toward the surface. Under the influence of gravity, these cuttings tend to fall through the ascending fluid. This is known as slip velocity. The slip velocity will depend upon the viscosity (thickness) and density of the fluid. The thicker the fluid, the lower the slip velocities. The more dense the fluid, the lower the slip velocity. For effective cuttings removal, the fluid velocity must be high enough to overcome the slip velocity of the cuttings. This means that fluid velocity can be lowered in a highly viscous (thick) or very dense fluid and cuttings still effectively removed from the well bore. The density of a fluid is determined by other factors and is not usually considered a factor in hole cleaning; therefore we limit adjustment of hole cleaning properties to viscosity and velocity adjustments to the drilling fluid. The viscosity desired will depend upon the desired hydraulics and the size of the cuttings contained in the fluid. The velocity will depend on several factors—the pump (capacity, speed, efficiency), the drill pipe size and the size of the bore hole.

The velocity of a fluid will determine its flow characteristics, or flow profile. There are five stages, or different profiles, for a drilling fluid: 1) no flow, 2) plug flow, 3) transition, 4) laminar, 5) turbulent. The ideal velocity is one that will achieve laminar (or streamline) flow because it provides the maximum cuttings removal without eroding the well bore. On the other hand, turbulent flow (resulting from too high a velocity or too low fluid viscosity) not only requires more horsepower but can cause excessive hole erosion and undesirable hole enlargement. The proper combination of velocity and viscosity is a must for the right hydraulics and efficient hole cleaning. Cuttings will have a tendency to collect at points of low fluid velocity in the well bore annulus. These areas are found in washouts and where the drill pipe rests against the wall of the well bore. To that end, it is a good practice to rotate the drill string while just circulating to clean the hole, as this will help keep the cuttings in the main flow of the fluid and not allow them to gather next to the wall or pipe.

When circulation is interrupted, the slip velocities of the cuttings will cause them to fall back to the bottom of the hole unless the drilling fluid can suspend the cuttings with its gel strength. Upon resumption of circulation, the fluid reverts back to its fluid state and carries the cuttings to the surface. This ability of developing gel properties while static and then becoming fluid again when pumped is called the thixotropic property of a drilling fluid. The ability of thickening at low velocities and thinning at high velocities is called the shear-thinning property of a drilling fluid. The magnitude of gel strengths and shear-thinning ability of a drilling fluid will depend upon the concentration and quality of clay solids in the fluid system.

Once the cuttings are out of the hole, they must be removed from the system to keep from being re-circulated. This can be done by using a low-gel-strength fluid and allowing the cuttings to settle out. The cuttings can also be removed by mechanical means such as gumbo chains, shale shakers, de-sanders or de-silters, centrifuges and cuttings dryers. If the cuttings are re-circulated, they are subjected to further grinding action and abrasion. As the cuttings become smaller, they become harder to remove and tend to remain in the system.

Over a period of time, this will cause undesirable Theological properties resulting in high chemical treatment costs and also slower penetration rates that result in higher well costs.

Considerable heat is generated by friction at the bit and where the drill string is in contact with the formation. This heat must be absorbed by the circulating fluid so that it can be transmitted to the surface and dissipated. The fluid also works to lubricate the bit and drill string. If additional lubricity is needed, there are several lubricating products which can be added to the system. The lubricity of the fluid helps to decrease torque, increase bit life, reduce pump pressure and reduce bit balling.

A drilling fluid will deposit a filter cake on the wall of the well bore. This wall cake helps protect the formation by retarding the passage of mud filtrate into it. The higher the permeability of a formation, the greater its ability to accept and receive large volumes of mud filtrate. Therefore, the nature of this filter cake will have a direct effect on such problems as formation damage, sloughing and caving, tight hole and stuck pipe. The type of wall cake is determined by the quantity and quality of particles in the mud system.

Performance advantage is the most significant, because borehole stability is the number one reason given for drilling fluids selection. Water based fluids can be engineered to perform (or out-perform if environmental factors/expense warrant) as well as oil based drilling fluid in all areas but shale stability. Hydrating shale, which makes up 75% of most marine depositional basins, is the main cause of lost hole and down hole drilling problems. Marine shale is composed of clays containing smectites and illites. Although illite is not as active (expanding, swelling) as the smectite group, illite will expand or destabilize over time. Oil based drilling fluid, with oil as the continuous phase and water tightly emulsified as droplets, does not provide a hydrating medium for the active clay content of marine shale's.

The low oil filtrate and excellent lubricity characteristics aid in reducing differential sticking in highly permeable formations and high angle holes.

An oil mud will not dissolve water soluble formations such as salt or gypsum; also provides stability from acid gas bearing formations.

The nonconductive, external phase of an oil mud prevents maximum protection for drill pipe and casing.

The permeability of producing sands is not reduced since the filtrate will not cause swelling and dispersion of hydrateable clays that are in the pores of the sand.

The proper restraint of formation pressures depends upon the density (weight) of the fluid. Abnormal high pressures can be controlled by the weighting up of a fluid with the addition of certain materials Sybarite is the most common). In some cases, however, a fluid can become too heavy and hydraulically fracture a formation, causing lost circulation.

The drilling fluid is the medium which transmits available hydraulic horsepower to the system. This horsepower is needed to move the fluid through the surface system, down the drill string, through the bit, up the annulus (the space between the hole wall and the drill pipe), through the pits and back to the suction pump. Fluid flowing from the bit nozzles exerts a jetting action that keeps the face of the hole and the teeth edge of the bit clear of the cuttings. The horsepower required to move the mud through the remaining system should be minimized in order to maximize horsepower at the bit. The heavier a fluid becomes, the greater the horsepower that is required to move it through the system. This results in less horsepower at the bit and slower penetration rates.

When a drilling fluid is controlled and properly maintained, it not only insures proper formation protection, optimum penetration rates, greater well production and lower equipment wear, but can also, within given parameters maximize downhole information. A hole is drilled into the ground to 1) gather information on those rocks penetrated by well bore, and 2) find and recover usable fluids. A properly controlled drilling fluid is necessary not only to recover adequate rock cuttings for their analysis and study, but also to safely control subsurface pressures, optimize penetration rates for controlling drilling costs, minimize formation damage and therefore maximize well productivity.

BRIEF SUMMARY OF THE INVENTION

The present invention relates to the heating of drilling, completion, and/or stimulation fluids including acidizing liquids but not limited to entering or exiting the well bore. This process will be utilized to pre-treat drilling/completion fluids entering the well bore as well as post treatment of the fluids exiting the well bore. The primary objective of the invention is to overcome colder conditions in the drilling fluid that will complicate well bore stability concerns and decreased drilled solids removal efficiencies. The functions of the drilling fluids, as listed earlier, will become enhanced by heating the drilling fluids as well as adding a significant economic savings for the user.

To carry out the method of the invention there will be provided a principal heat exchange vessel; i.e., plate & frame, shell & tube, fintube, spiral coil, platecoil and embossed immersion heat transfer panels, a first inlet for introducing heat transfer media i.e., heat transfer oil, "hot oil" heated air, or steam into fluid flow lines within the vessel; an outlet for flowing the heat transfer media from the vessel; a second inlet for introducing drilling and/or completion fluids returning from or returning to the well bore for receiving heat from the heat transfer media within the fluid flow lines in the vessel; an outlet for flowing the heated downhole fluids from the vessel to be returned down the borehole; a heater i.e., diesel "propane or natural gas" fired, steam, hot air, electrical or the like for heating the heat transfer media to a desired temperature before returning the heat transfer media to the heat exchange vessel. Optimally, the drilling or completion fluid would be heated to 50 to 60F above ambient temperature.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
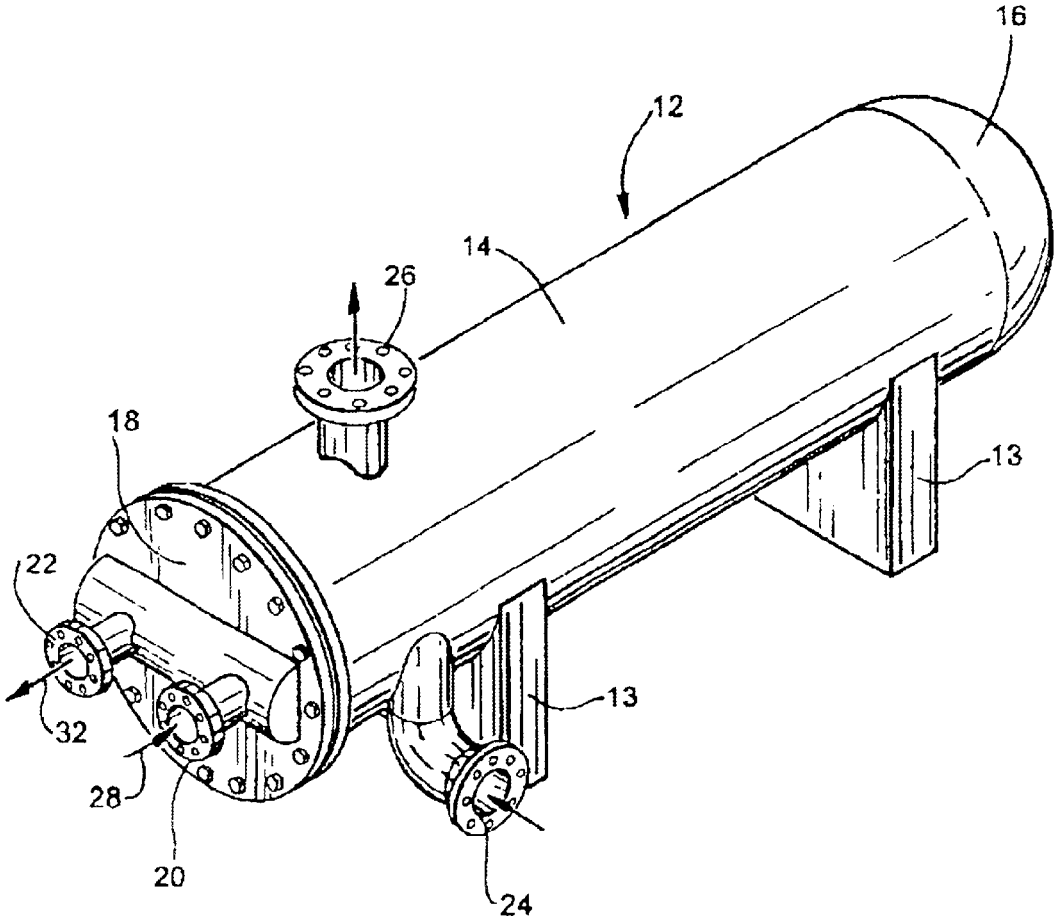
FIG. 1 illustrates an overall view of the heat exchange vessel utilized in the system and method of the present invention.

FIGS. 1 through 4 illustrate the preferred embodiment of the system to carry out the process of the present invention. Before referring to the drawings, in general, the process of the present invention is designed to heat the drilling fluids using a heat exchanger i.e., plate & frame, shell & tube, fintube, spiral coil, plate coil, and embossed immersion heat transfer panels, in conjunction with a heat transfer media, i.e. heat transfer oil "hot oil", heated air, or steam or like heating device. The heat transfer media is heated through a source that will circulate through the heat exchangers plates or coils to raise the temperature of the drilling/completion fluids while they circulate over the heat exchanger plates or coils.

The heat transfer media circulates through the plates in a closed loop system that is not exposed to the drilling fluids. The heat exchanger transfers the heat to the drilling fluid while they circulate around the plates, raising the temperature of the drilling fluids.

The process will raise the temperature of the drilling fluids that are to be pumped down hole or treated after the fluid is returned from down hole. The process allows for the enhancement of the properties of the drilling fluids prior to pumping down hole. During the post treatment of the fluids being returned from down hole it can enhance the drilling fluid prior to treatment of the liquids and entrained drilled solids entering the solids control equipment.

Figure 2:
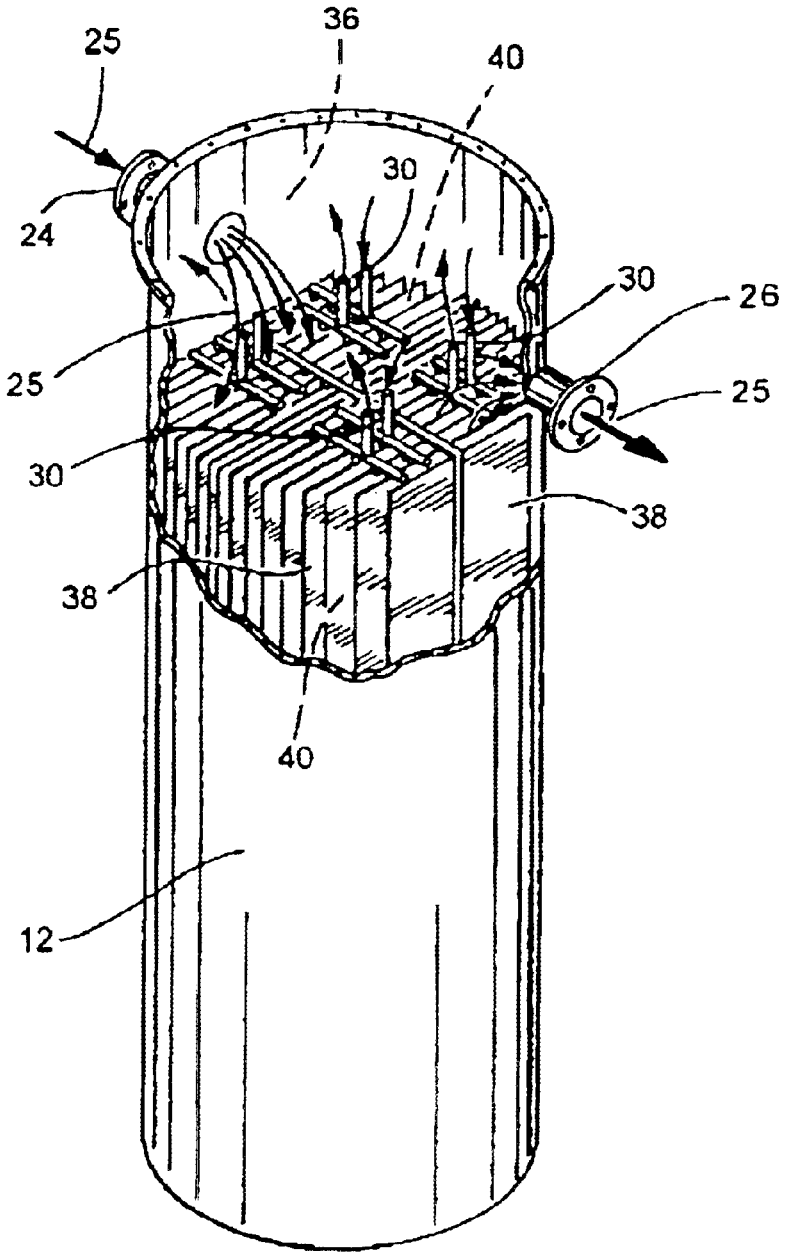
FIG. 2 illustrates a partial cutaway view of the heat exchange vessel utilized in the system and method of the present invention.

FIG. 1 illustrates the heat exchange vessel 12 resting on a base 13. The vessel 12 comprises a continuous sidewall 14, a first closed end 16 and a second end 18, having a first heat transfer media inlet opening 20 and a second heating fluid outlet 22. The sidewall 14 illustrates a drilling/completion fluid inlet 24 and a drilling/completion fluid outlet 26. In operation, as stated earlier, the heat transfer media, i.e., heat transfer oil system, heated air, or steam or like heating device, depicted as arrow 28 would enter the inlet 20 to be circulated through the vessel 12, through a series of fluid flow lines 30, as seen in FIG. 2. The heat transfer media would exit the outlet 22, arrow 32, to be re-heated so the fluid 30 can be returned into the vessel 12 to carry out its heat exchange function. The heat transfer media 28 would flow within closed flow lines 30, and would never make direct contact with the drilling/completion fluid flowing through the vessel.

Reference is now made to FIG. 2, where there is illustrated the interior 36 of vessel 12. The interior 36 would include the plurality of heating fluid lines 30 with heat transfer media flowing there through. The interior 36 would also include a plurality of heating plates 38, defining a plurality of flow spaces 40 therebetween. As seen, the drilling/completion fluid (arrow 25) would enter into the inlet 24 and flow between the various heating plates 38 to be heated to a desired temperature. The drilling/completion fluid 25, upon reaching the desired temperature would flow from the vessel 12 via flow line 26. The heated fluids, upon leaving vessel 12 would either be returned down the borehole, or if the fluid is returning from the borehole to be heated, the fluid would then flow to the solid removal systems to remove the solids carried from the borehole. The fluid would then be routed into the vessel 12 to obtain sufficient heat before returning down the well bore.

Figure 3:
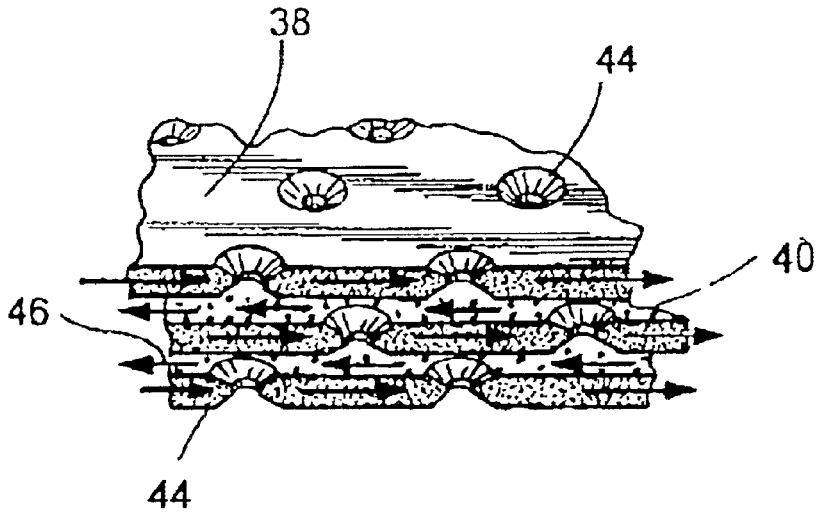
FIG. 3 illustrates a partial view of the surface features of the heat exchange plates utilized in the system and method of the present invention.

As seen in FIG. 3, in a particular embodiment, the heating plates 38 may include a plurality of dimples 44 in their surfaces to serve as additional structural support for the plates 38 in the heat exchange function of the drilling/completion fluids flowing therebetween in spaces 40, as depicted by arrows 46. This dimple construction is optional and may not be utilized in all embodiments of the invention.

Figure 4:
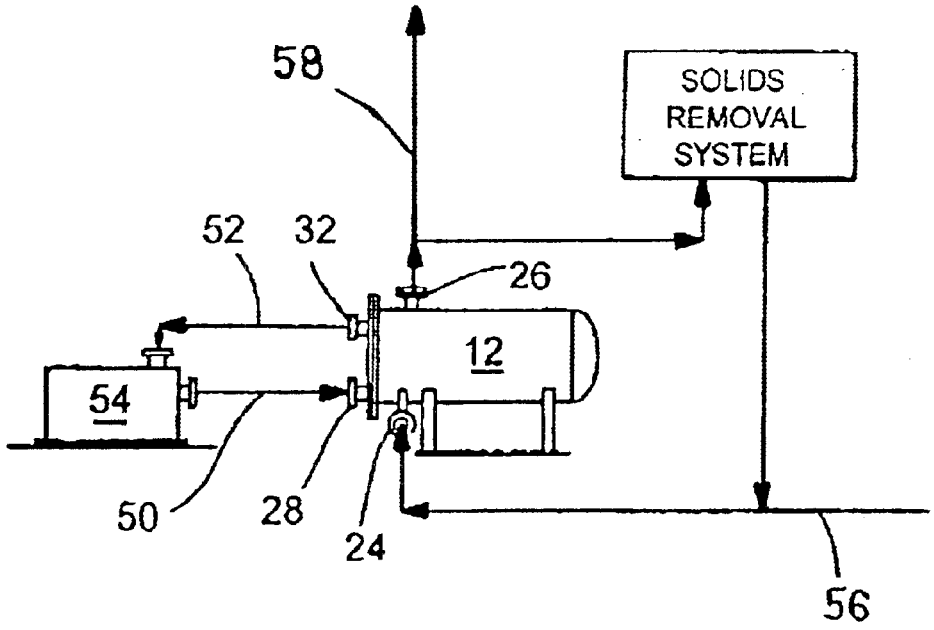
FIG. 4 illustrates an overall view of the system of the present invention.

FIG. 4 represents a view of the complete closed loop system, illustrating the vessel 12, with the heat transfer media fluid flowing through line 50 into the inlet port 28 into vessel 12, where the heat transfer media will heat the drilling/completion fluids flowing through the vessel. The heat transfer media would then return via line 52 into the heater 54, to be reheated so that it can return to the vessel 12. Likewise arrows 56 illustrate the drilling/completion fluid returning from the well bore into inlet port 24 in vessel 12, where the fluid is heated and then exits vessel 12 via outlet port 26 where the fluid is returned down the well bore through line 58. Of course is the fluid is coming from the wellbore, carrying solids, it may be entering the vessel 12 to pick up heat before it goes into the solid removals part of the system. Because the fluids returning from the well bore are cold, the returning fluids will be heated prior to the solids control system and once again before it is returned to the well bore. These two heating steps are separate applications and will be dictated according to needs in a certain application.

The system will have the flexibility to increase the temperature of the drilling/completion fluid from 10° F. to 90° F. If the fluids are received at 60° F., and the fluid is heated to 120° F., there will have been a 60° F. change in fluid temperature. Depending on the applications, there could be varying flow capacities of 50 gpm to 2000 gpm per system but not limited to. The optimal temperature will vary and will be dependent upon the inlet temperature of the fluid to the heat exchanger. It is projected that if the fluid were taken at ambient' temperature, and it was raised 50° F. to 60° F., that would provide the best result for both heating applications. The capability of the system allows for raising the temperature of the fluid upward toward 150° F. above ambient if required. The foregoing embodiments are presented by way of example only; the scope of the present invention is to be limited only by the following claims.

What is claimed is:

1. A system for pre-heating downhole fluids returning from a well bore, the system comprising:

a. a principal heat exchange vessel;

b. an inlet for allowing a heat transfer media to circulate through the vessel through a plurality of heating fluid flow lines;

c. a first outlet for flowing the heat transfer media from the vessel;

d. a second inlet for introducing fluids returning from the well bore for receiving heat from the heat transfer media within the fluid flow lines in the vessel for pre-heating the downhole fluids to a desired temperature;

e. an outlet for flowing the heated downhole fluids from the vessel to a solids removal system;

f. means for flowing the downhole fluids from the solids removal system to the principal heat exchange vessel to be post-heated before returning down the well bore; and g. heating means for heating the heating fluid to a desired temperature before returning the heating fluid to the heat exchange vessel.

2. The system in claim 1, wherein the heat exchange vessel is of the type which includes plate & frame, shell & tube, fintube, spiral coil, platecoil and/or embossed immersion heat transfer panels.

3. The system in claim 1, wherein the fluids from the well bore comprises drilling, completion, and/or stimulation fluids including acidizing liquids.

4. The system in claim 1, wherein the heat transfer media comprises heating oil or a similar heat exchange medium.

5. The system in claim 3, wherein the drilling, completion, and/or stimulation fluids including acidizing liquids would be heated to 50° to 60° F. above ambient temperature.

6. The system in claim 3, wherein the drilling, completion, and/or stimulation fluids including acidizing liquids could be heated to a temperature of 150° F.

7. A method of heating downhole fluids returning from a borehole, comprising the following steps:

a. providing a heat exchange vessel;

b. flowing a heated fluid into the heat exchange vessel;

c. flowing the downhole fluid returning from the borehole into the vessel to receive heat from the heated fluid in a non-direct contact;

e. flowing the heated borehole fluid into a solids removal system to remove solids carried by the fluid from downhole; and f. flowing the downhole fluid from the solids removal system to the heat exchange vessel to be heated to a temperature 50° F. to 60° F. above ambient temperature; and g. returning the heated borehole fluid into the borehole.

8. The system in claim 7, wherein the fluids from the bore hole comprises drilling, completion, and/or stimulation fluids including acidizing liquids.

9. The system in claim 7, wherein the heating fluid comprises hearing oil or a similar heat exchange medium.

10. The system in claim 8, wherein the drilling, completion, and/or stimulation fluids including acidizing liquids could be heated to at least 150° F.

* * * * *